US007204040B2

(12) United States Patent
Myung et al.

(10) Patent No.: US 7,204,040 B2
(45) Date of Patent: Apr. 17, 2007

(54) APPARATUS FOR SUPPLYING HOT AIR IN DRUM TYPE WASHER WITH DRY FUNCTION

(75) Inventors: Hwan Joo Myung, SuwonGyeonggi-do (KR); Choong Hwi Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/057,377

(22) Filed: Feb. 15, 2005

(65) Prior Publication Data

US 2006/0021250 A1 Feb. 2, 2006

(30) Foreign Application Priority Data

Feb. 27, 2004 (KR) ..... 10-2004-0013266
Feb. 27, 2004 (KR) ..... 10-2004-0013270
Feb. 27, 2004 (KR) ..... 10-2004-0013271

(51) Int. Cl.
*F26B 11/02* (2006.01)

(52) U.S. Cl. ..... 34/604; 34/596; 34/134

(58) Field of Classification Search ..... 34/604, 34/605, 606, 607, 608, 609, 610, 134, 596; 68/19.2, 20, 13 R
See application file for complete search history.

(56) References Cited

U.S. PATENT DOCUMENTS 6,966,124 B2 * 11/2005 Ryu ..... 34/134
2003/0200773 A1 10/2003 Hong et al.
2004/0165985 A1 * 8/2004 Satoh et al. ..... 415/206

FOREIGN PATENT DOCUMENTS

EP 0344 549 12/1989

* cited by examiner

*Primary Examiner*—Kenneth Rinehart
(74) *Attorney, Agent, or Firm*—McKenna Long & Aldridge LLP

(57) ABSTRACT

The present invention provides a drum type washer with dry function, by which a product cost is lowered and by which compatibility of a blower cover is enhanced. The present invention includes a first duct housing provided to a tub included in the drum type washer, a second duct housing provided to an upper side of the first duct housing, a blower cover provided to the upper side of the first duct housing adjacent to the second duct housing, the blower cover being formed of a synthetic resin based injection material, a heater provided between the first and second duct housings, a motor provided to the blower cover, and a blower provided under the blower being rotatably connected to the motor.

20 Claims, 10 Drawing Sheets

APPARATUS FOR SUPPLYING HOT AIR IN DRUM TYPE WASHER WITH DRY FUNCTION

This application claims the benefit of the Korean Application No. P2004-13270; P2004-13271 and P2004-13266 filed on Feb. 27, 2004, which is hereby incorporated by reference.

BACKGROUND OF THE INVENTION

1. Field of the Invention

The present invention relates to a drum type washer with dry function, and more particularly, to an apparatus for supplying hot air in a drum type washer with dry function, by which a laundry within a drum can be dried in a manner of forcibly blowing the generated hot air to the drum.

2. Discussion of the Related Art

Generally, a drum type washer with dry function is an apparatus for removing dirt or filth from a laundry inputted to a drum using a proper detergent and mechanical force through washing, rinsing, dewatering, and drying cycles.

FIG. 1 is a cross-sectional diagram of a drum type washer with dry function according to a related art, and FIG. 2 is a perspective diagram of a hot air supplying device consisting of a drying duct and a blower according to a related art.

Referring to FIG. 1 and FIG. 2, a tub 4 is installed within a cabinet 2 to be horizontally supported by a spring and damper (not shown in the drawing). A cylindrical drum 5 is rotatably installed within the tub 4 to wash a laundry inputted thereto. A motor 7 is installed under the tub 7. A drive pulley (not shown in the drawing) connected to the motor 7 via a belt 6 is provided in rear of the tub 4 to rotate the drum forward or reversely. A water supply hose 9 connected to a water supply source is provided to one side of an upper part of the cabinet 2 to supply a detergent to the tub 4 via a detergent box 8. A drain hose 11 connected to a drain pump 10 is provided to one side of a lower part of the cabinet 2 to drain water within the tub 4 outside. And, a door (not shown in the drawing) opening/closing a front portion of the drum 5 is revolvably provided to a front portion of the cabinet 2.

A drying duct 30, in which a heater 36 and a blower 34 are built to blow out hot air into the tub, is provide over the tub 4. A condensing duct 40 is provided to one side of the tub 4. One end of the condensing duct 40 communicates with a lower lateral part of the tub 4 and the other end of the condensing duct 40 communicates with the drying duct 30. Hence, the condensing duct 40 forms a circulation path together with the drying duct 30 and the tub 4. A water supply nozzle 4 is provided to one side of the condensing duct 40 to remove humidity from air introduced from the tub 4 in a manner of flowing cooling water.

The drying duct 30, as shown in FIG. 2, consists of a metallic upper housing 31, a metallic lower housing 32, and a blower cover 33 connected to one side of the upper housing 31. Moreover, a motor 35 and the blower 34 are assembled to each other centering on the same axis by leaving the blower cover 33 in-between.

The heater 36 is attached within the drying duct 30 to heat air flowing within the duct.

A motor guide 37 is provided to the blower cover 33 to have a recess for receiving the motor 35 therein. A power cable guide slot is provided to the motor guide 37 to guide a power cable 39 of the motor 35. A flange 33*a* is provided to an outer circumference of the blower cover 33 to be loaded on an outer circumference of the lower housing 32, and a plurality of locking holes 33*b* are provided to both sides of the flange 33*a* for screw-coupling with the lower housing 32.

The above-configured drying duct and blower 30 and 34 according to the related art are manufactured by iron-casting.

However, the related art drum type washer with dry function has the following problems or disadvantages.

First of all, a locking place of the lower housing configuring the drying duct is varied according to a washing capacity of the washer, and a size of the blower drive motor and an installation direction of the power cable 39 are changed as well. Hence, the blower cover 33 needs to be modified to correspond to the washing capacity of the washer. If the blower cover is applied to a specific washing capacity only, the product cost is raised as well as maintenance and management get difficult.

Secondly, the upper and lower housings 31 and 32 configuring the drying duct 30 of the related art drum type washer with dry function are manufactured by iron casting using steel. And, the blower 34 and the blower cover 33 are made of steel or stainless steel by casting or metallic processing. Hence, the corresponding product costs are high to raise the product cost of the washer/dryer.

Specifically, in case of the blower 34, a rim 34*a*, a base 34*b*, and a blade 34*c* need to be separately formed to be assembled. Hence, the corresponding manufacturing process is considerably complicated to further raise the product cost.

SUMMARY OF THE INVENTION

Accordingly, the present invention is directed to a drum type washer with dry function that substantially obviates one or more problems due to limitations and disadvantages of the related art.

An object of the present invention is to provide a drum type washer with dry function, by which a manufacturing process of a drying duct is simplified and by which a product cost is lowered.

Another object of the present invention is to provide a drum type washer with dry function, by which compatibility of a blower cover is enhanced to cope with variable sizes of a drying duct and motor according to washing capacity.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for supplying hot air in a drum type washer according to the present invention includes a first duct housing provided to a tub included in the drum type washer with dry function, a second duct housing provided to an upper side of the first duct housing, a blower cover provided to the upper side of the first duct housing adjacent to the second duct housing, the blower cover being formed of a synthetic resin based injection material, a heater provided between the first and second duct housings, a motor provided to the blower cover, and a blower provided under the blower cover, the blower being rotatably connected to the motor.

In another aspect of the present invention, an apparatus for supplying hot air in a drum type washer with dry function includes a first duct housing provided to a tub included in the drum type washer, a second duct housing provided to an upper side of the first duct housing, a blower cover provided to the upper side of the first duct housing adjacent to the second duct housing, the blower cover being formed of a synthetic resin based material, the blower cover having a recess, a heater provided between the first and second duct housings, a motor coupled with the recess of the blower cover, a blower under the blower cover, the blower being rotatably connected to the motor, and a motor guide protruding upward along an outer circumference of the recess of the blower cover, the motor guide including a plurality of bosses having screws locked therein for coupling with the motor, respectively and at least one escape recess for receiving a projected portion of a locking screw separately locked in the motor.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
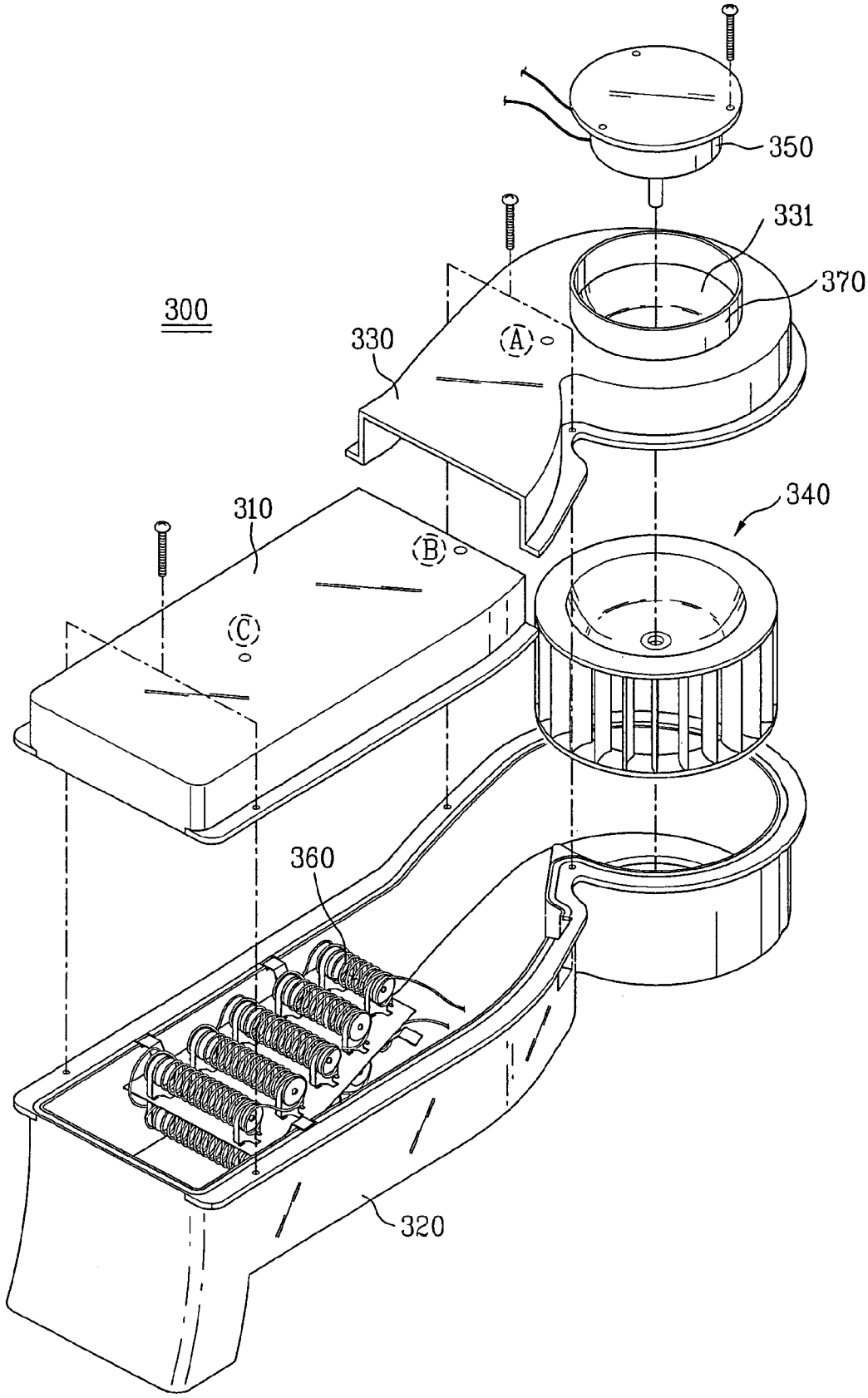
FIG. 3 is a projected perspective diagram of a hot air supplying apparatus according to one embodiment of the present invention.

FIG. 3 is a projected perspective diagram of a hot air supplying apparatus according to one embodiment of the present invention.

Referring to FIG. 3, a hot air supplying apparatus 300 according to one embodiment of the present invention includes a lower housing 320 forming a air-flowing passage, an upper housing 310 assembled to a top portion of the lower housing 320, and a blower cover 330 assembled to a top portion of the lower housing 320 at one side of the upper housing 310 to contact with the upper housing 310. Additionally, the upper housing 320, the lower housing 310, and the blower cover 330 construct a drying duct for air-flowing.

Figure 1:
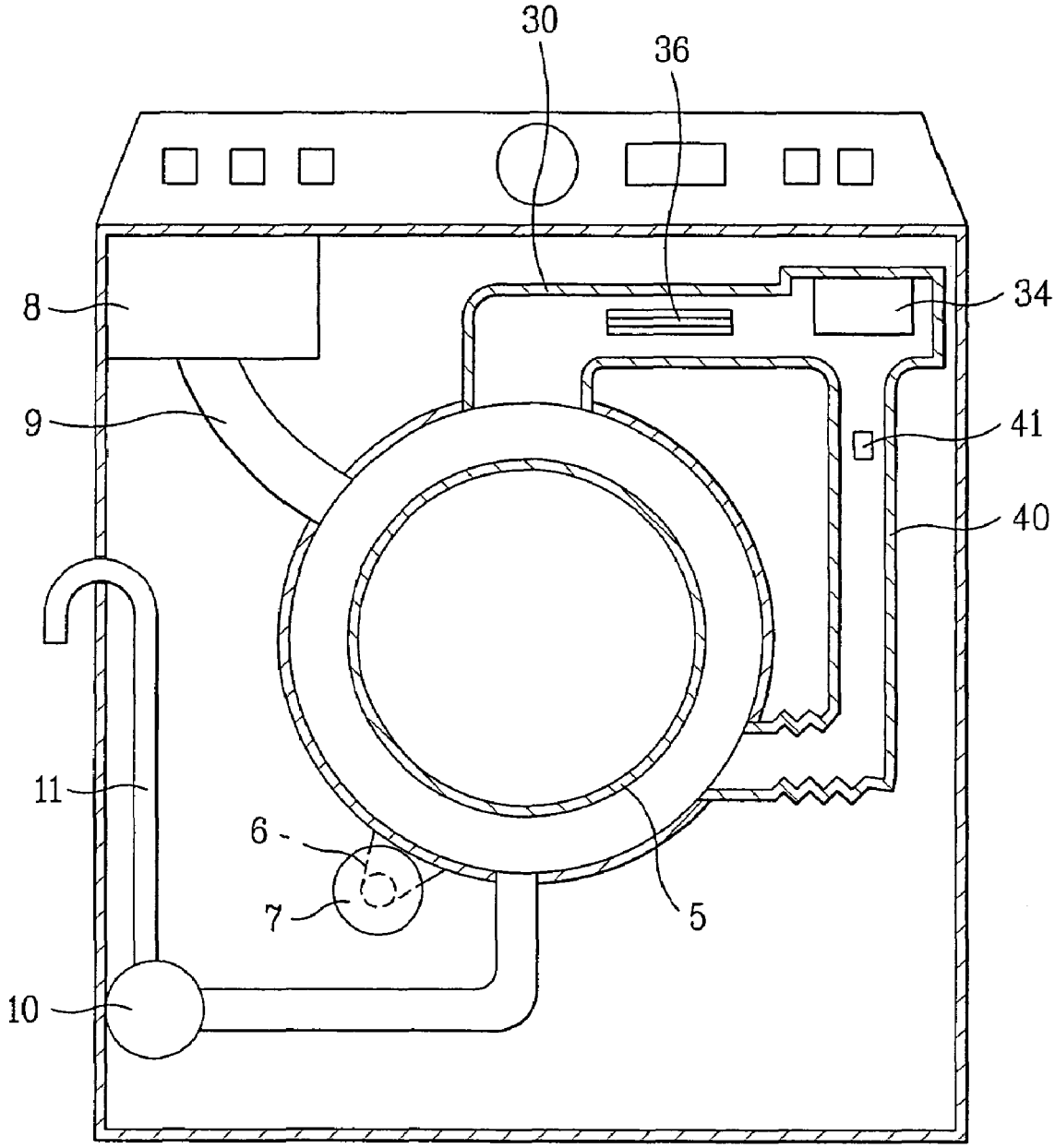
FIG. 1 is a cross-sectional diagram of a drum type washer with dry function according to a related art.
Figure 2:
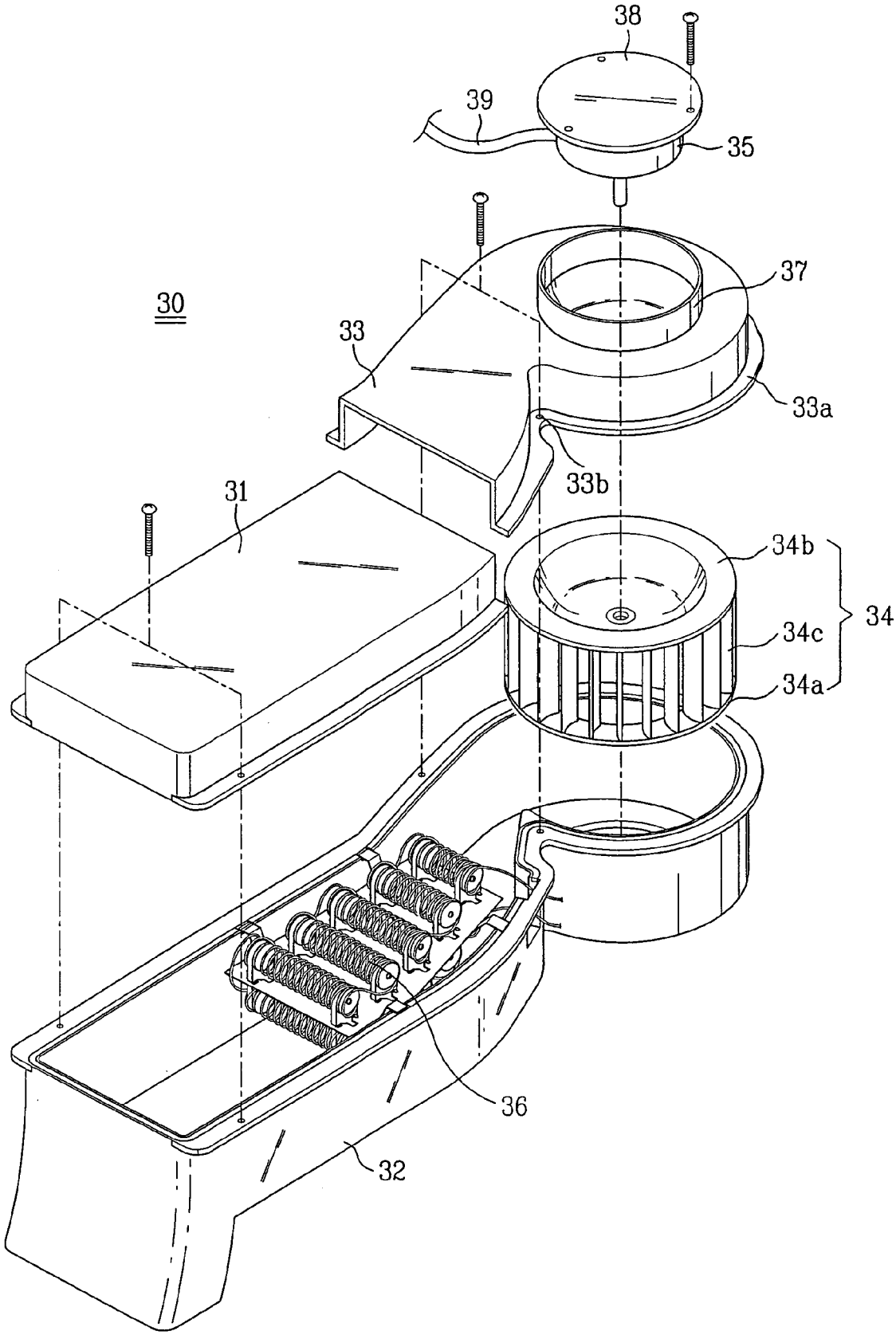
FIG. 2 is a perspective diagram of a hot air supplying device consisting of a drying duct and a blower according to a related art.

The blower 340 is provided to one end of the lower housing 320, and more specifically, to a portion of the lower housing 320 communicating with the condensing duct 40 in FIG. 1, and a heater 360 is provided to an opposite side to the lower housing 320 to heat air blown by the blower 340.

The lower housing 320 can be formed by casting using steel. Moreover, the upper housing 310 can be formed by pressing using a zinc plate or preferably by injection molding using a synthetic resin material such as a plastic material. Alternatively, the upper housing 310 can be formed by casting using steel like the lower housing 320 as well.

Preferably, the blower 340 is formed by injection molding of a synthetic resin material having a high heat-resistant property.

Preferably, the blower cover 330 is formed by injection molding of a synthetic resin material having a high heat-resistant property.

A recess 331 for receiving a motor 350 driving the blower 340 therein is provided to the blower cover 330. Moreover, a motor guide 370 protrudes from a circumference of the recess 331 to load the motor 350 therein and to fix the motor 350 thereto. A rotational shaft of the motor 350 penetrates into the blower cover 330 to be coupled to the blower 340 for shaft-coupling.

An operation of the hot air supplying apparatus according to the present invention is explained as follows.

Figure 4:
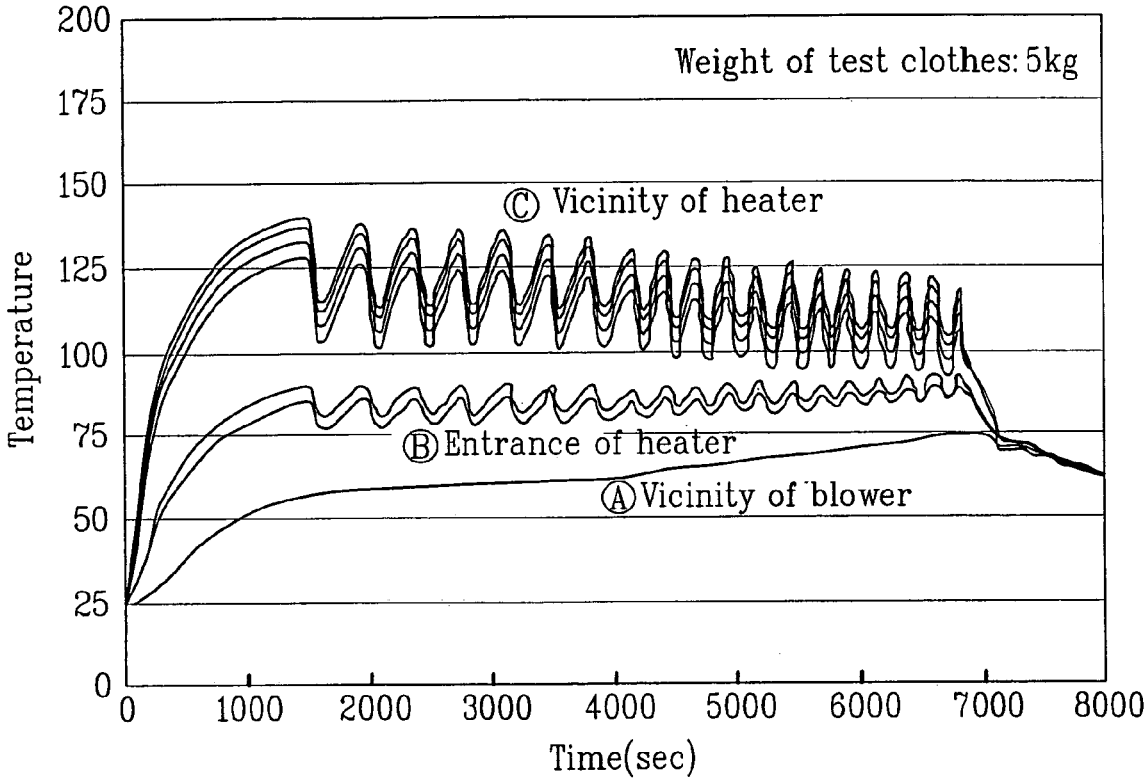
FIG. 4 is a graph of temperature measurement results at major parts of a blower and drying duct on a drying operation.

FIG. 4 is a graph of temperature measurement results at major parts of a blower and drying duct on a drying operation.

Referring to FIG. 4, temperature sensors are attached to a portion A of the blower cover 300 having the blower 340 installed therein, a heater entrance B in the vicinity of a connecting part between the blower cover 330 and the upper housing 310, and a portion C of the upper housing 310 provided over the heater 360, respectively. A drying cycle is then carried out to measure temperature variations of the respective portions A, B, and C according to time.

As a result of the test, the vicinity A of the blower 340 has a maximum temperature of 75° C. and the entrance B of the heater 360 has a temperature of about 80° C.

Namely, the vicinity of the blower cover 330 in the vicinity of the blower 340 has a prescribed amount of heat dissipation and cooling effects attributed to a rotation of the blower 340. Air that passes through the blower 340 and the blower cover 330 is further passed through the condensing duct 40 in FIG. 1 to decrease in humidity and temperature. Hence, the temperature is not so high as to break down the synthetic resin material having high heat-resistant property.

Based on the measurement result, a synthetic resin having an excellent heat-resistant property such as PVDF (polyvinylidene fluoride), POM (polyactal copoymer), and the like is preferably used as a material having excellent resistant properties against moisture, strong alkalinity, and oxidation. The POM can sustain excellent properties including mechanical strength, hardness, creep-proof, and the like as well as various kinds of mechanical feasibility by 100° C. Furthermore, the PVDF has a melting point of 170~185° C. and a continuously usable temperature of 120° C. that is the lowest among fluoride resins. Yet, the PVDF has excellent processing features of injection molding, pressing forming, and the like as well as excellent mechanical and weathering properties.

Of course, other synthetic resins such as PC (polycarbonate), each of which has high heat-resistant property and good low-temperature characteristic and us usable between (−)100~135° C., can be employed as well.

If the blower 340, the blower cover 330, and the upper housing 310 are formed by an injection process using a highly heat-resistant synthetic resin, they can be manufactured by a single process unlike the casting method which requires multiple steps. Hence, it is able to lower product cost, thus reducing overall product cost.

Figure 6:
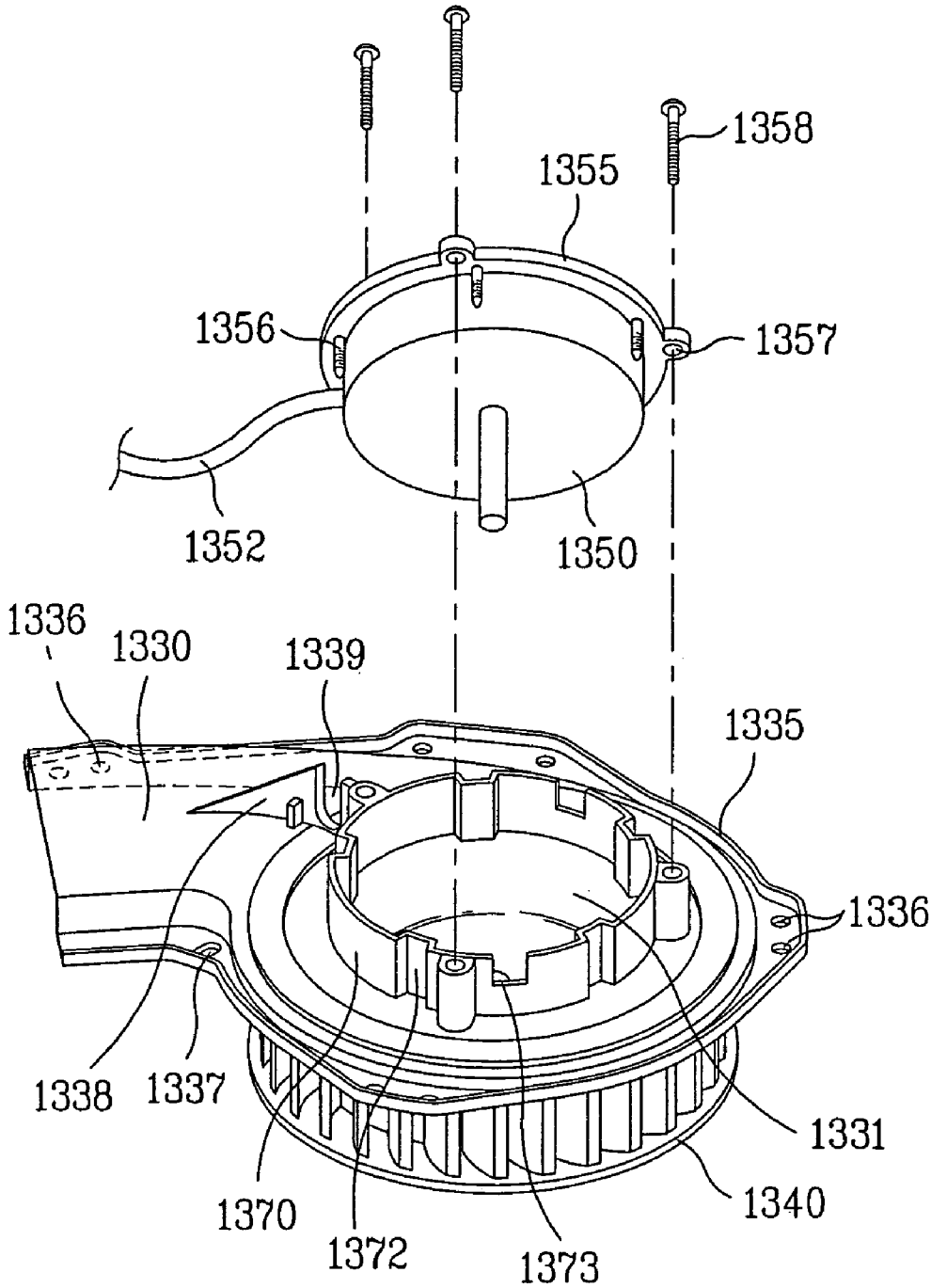
FIG. 6 is a projected perspective diagram of major parts of the hot air supplying apparatus of FIG. 5.
Figure 7:
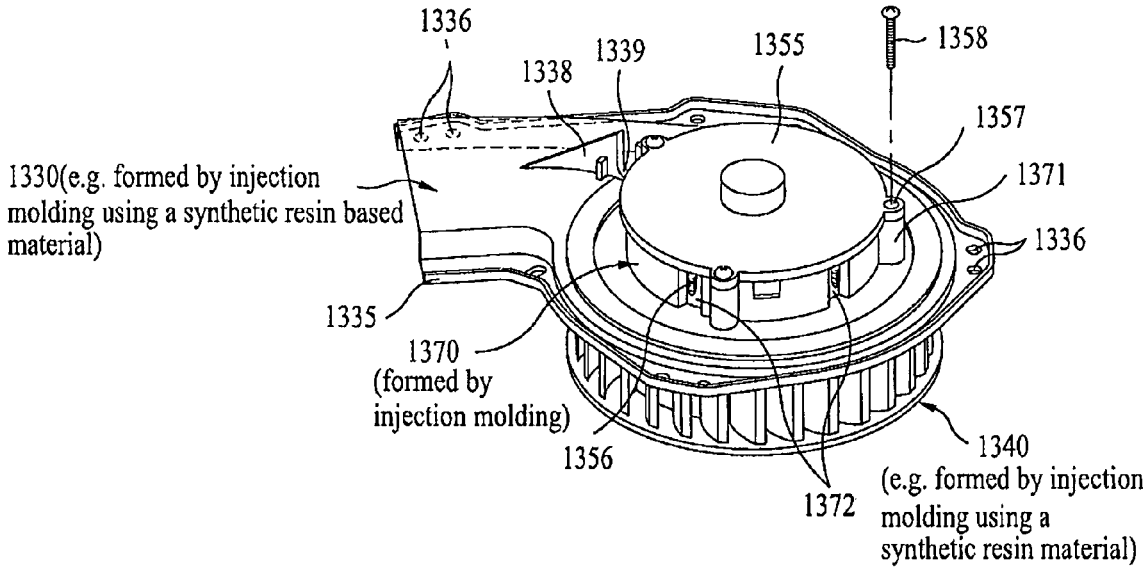
FIG. 7 is a perspective diagram of a lock hole comprising a square shape.

A hot air supplying apparatus according to another embodiment of the present invention is explained with reference to FIGS. 5 to 7 as follows.

First of all configurations and materials of a lower housing 1320, an upper housing 1310, and a blower 1340 of a hot air supplying apparatus 1300 according to another embodiment of the present invention are substantially identical to those of the former hot air supplying apparatus 300 according to one embodiment of the present invention. However, the hot air supplying apparatus 1300 according to another embodiment of the present invention differs from the apparatus 300 in configurations of a blower cover 1330 and a motor 1350 assembled to the blower cover 1330.

Specifically, a recess 1331 is provided to the blower cover 1330 to receive the motor 1350 therein. A motor guide 1370 protrudes upward along a circumference of the recess 1331. A plurality of bosses 1371 are built in one body of the motor guide 1370 to fix the motor 1350 and the motor guide 1370 to each other. A plurality of cable guide slots 1373 are provided to the motor guide 1370 to draw out a power cable 1352 of the motor 1350 that is loaded in the blower cover 1330. Preferably, each top end of the cable guide slots 1373 is fully open.

A motor cover 1355 is fixed to a top portion of the motor 1350 via a plurality of locking screws 1356. In doing so, each of the locking screws 1356 is slightly projected downward. Hence, it is preferable that a plurality of escape recesses 1372 are concavely provided to the motor guide 1370 to receive the corresponding locking screws 1356 therein, respectively. Each of the escape recesses 1372 plays a role in preventing a lower end of the projected locking screw 1356 from colliding with the motor guide 1370, thereby smoothing the corresponding locking.

Meanwhile, the drum type washer with dry function is differently manufactured according to washing capacity such as 7.5 kg, 10 kg, and the like. Hence, a size and configuration of the motor 1350 driving the blower 1340 are designed differently to correspond to the washing capacity. The recess 1331 having the motor 1350 received therein has a depth enough for each of the various motors 1350 to be locked therein.

A position of the power cable 1352 for supplying power of the motor is varied according to the corresponding one of the various motors. Hence, a plurality of the cable guide slots 1373 are provided along a circumference of the motor guide 1370 not to interfere with the position of the power cable 1352 of the motor.

Meanwhile, a pump (not shown in the drawing) is provided to a lower part of the drum type washer with dry function. Moreover, a hose connected to the pump may traverse over the drying duct due to a configurational reason. Thus, if a hose or cable of an external device traverses over the drying duct, a guide part 1338 and a support recess 1339 are preferably provided to one side of the motor guide 1370 to support the hose or cable. In this case, the support recess 1339 having an open top is provided to the guide part 1338.

A flange 1335 is provided to a circumference of the blower cover 1330 except the portion connected to the upper housing 1310 to be loaded on an outer circumference of the lower housing 1320. A plurality of locking holes 1336 are provided to the flange 1335. A plurality of the locking holes 1336 are preferably provided to leave a prescribed distance from each other to secure compatibility of the lower housing 1320 of which locking position through the locking holes 1336 varies according to capacity of the washer/dryer. Optionally, each of the locking holes 1336 may be a long hole 1337.

Figure 8:
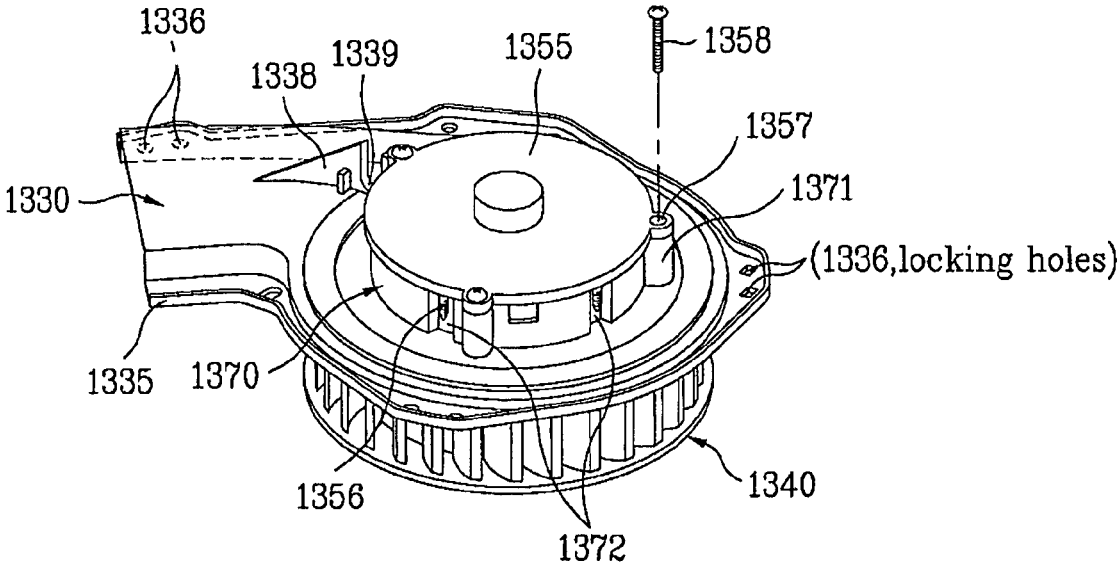
FIG. 8 is a perspective diagram of a lock hole comprising a square shape.
Figure 9:
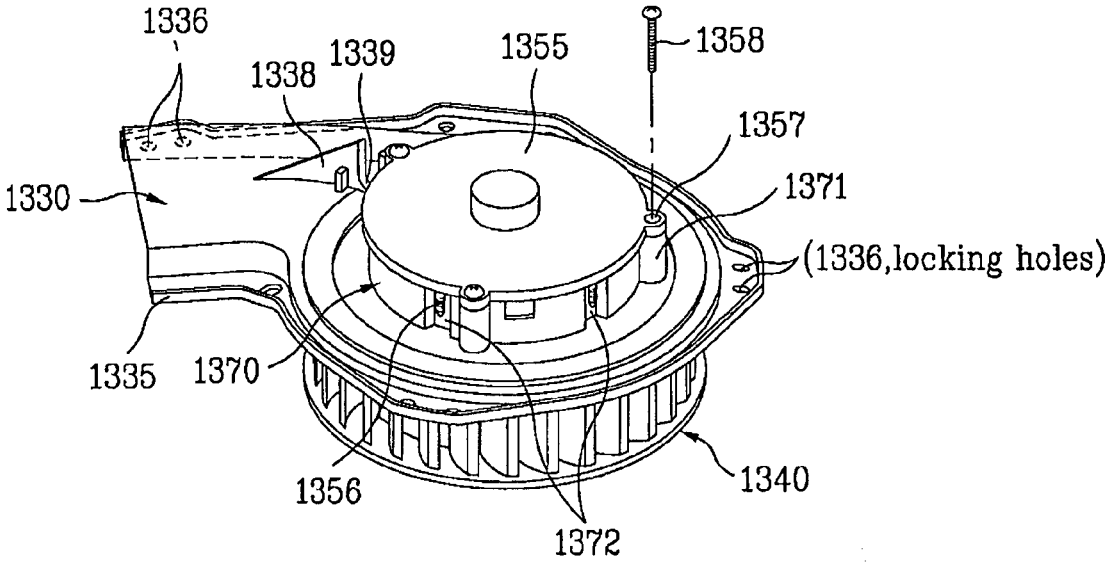
FIG. 9 is a perspective diagram of different exemplary representations of a lock hole comprising an oval shape.
Figure 10:
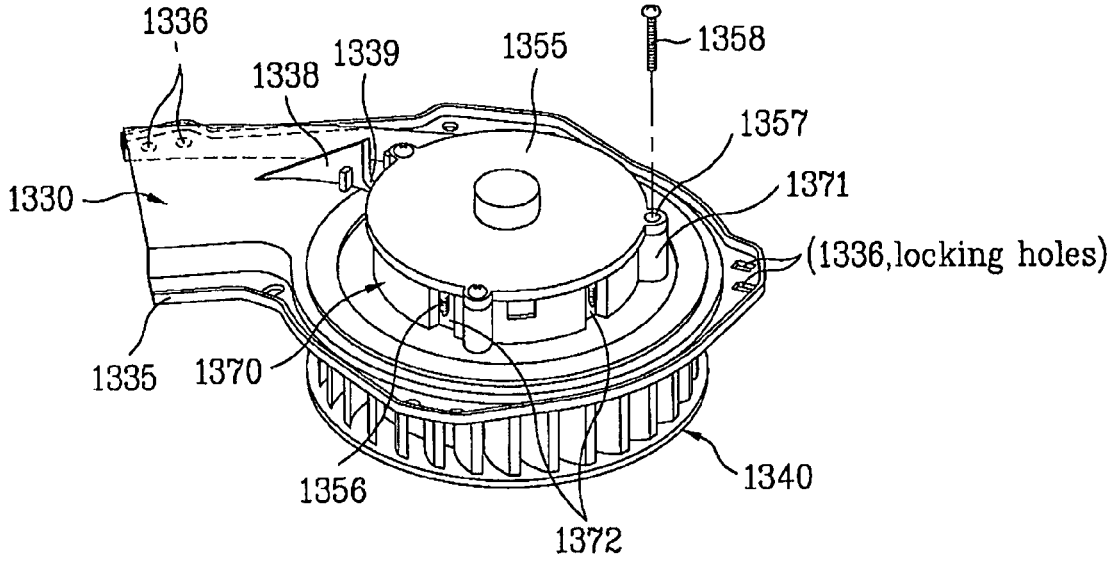
FIG. 10 is a perspective diagram of different exemplary representations of a lock hole comprising a rectangular shape.

Also, a shape of the locking hole comprises at least one of a circular, square, oval, or rectangular shape. Exemplary and non-limiting perspective views and representations of locking holes comprising a square, oval and a rectangular shape are respectively illustrated in FIGS. 8–10.

Preferably, the blower 1340 and the blower cover 1330 are formed by injection molding using a synthetic resin material having an excellent heat-resistant property such as plastic. Preferably, the motor guide 1370 is formed by injection molding together with the blower cover 1330. Alternatively, the motor guide 1370 can be separately formed by injection molding and assembled to the blower cover 1330.

An assembling process of the above-configured hot air supplying apparatus according to the present invention is explained as follows.

First of all, the motor cover 1355 is assembled to the top portion of the motor 1350 using the locking screws 1356. In doing so, the locking screws 1356 are slightly projected downward.

Subsequently, the motor 1350 is inserted inside the recess 1331 of the blower cover 1331 to be loaded in the motor guide 1370. In doing so, the power cable 1352 of the motor 1350 is drawn out via the guide slot 1373. Furthermore, the locking screws 1356 are inserted in the escape recesses 1372 of the motor guide 1370 to prevent interference with a surface of the motor guide 1370, respectively.

Screws 1358 are then locked via the locking holes 1357 of the motor 1350 and the bosses 1371 of the motor guide 1370, respectively to fixedly assemble the motor 1350 to the motor guide 1370.

Figure 5:
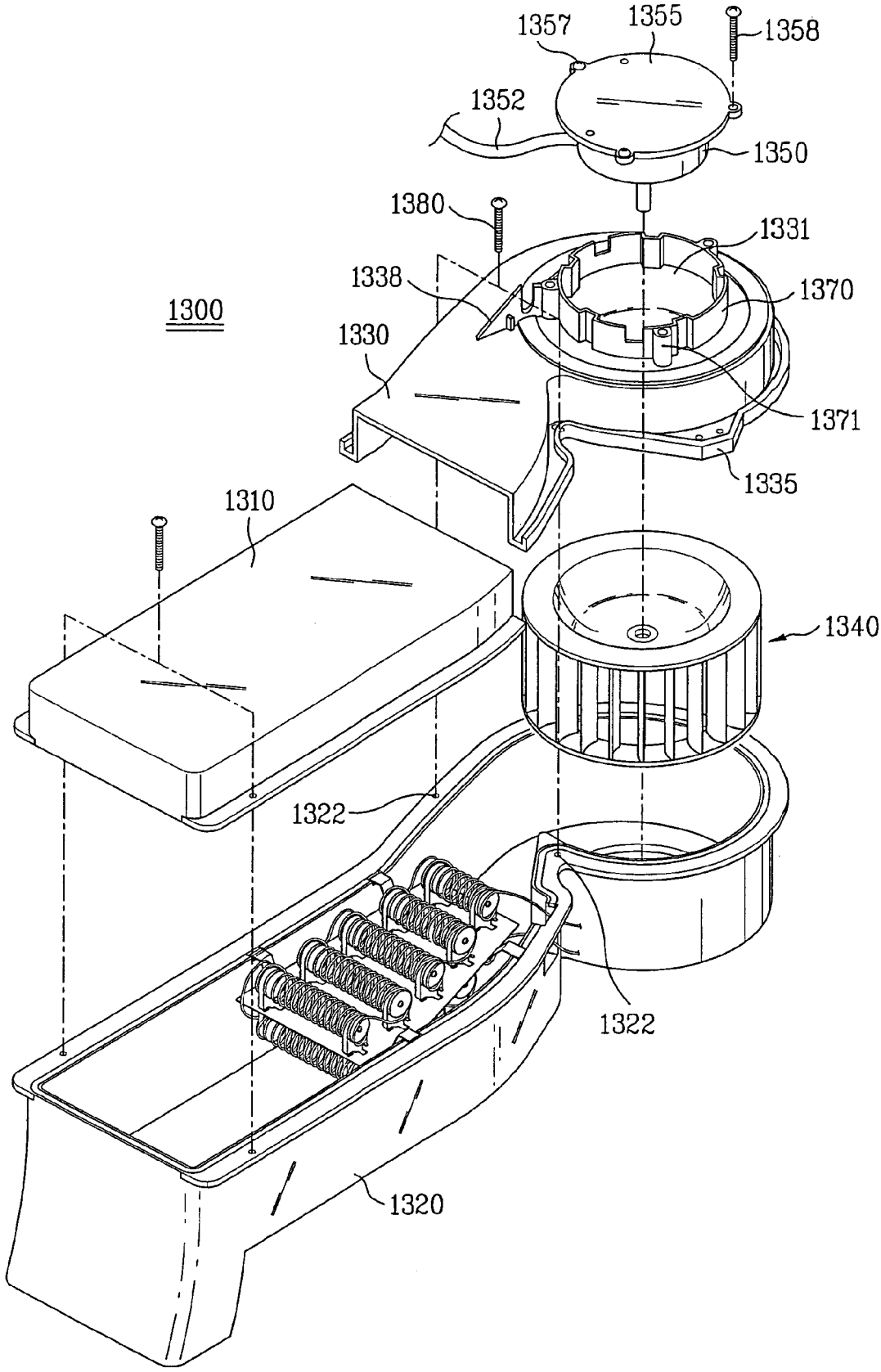
FIG. 5 is a projected perspective diagram of a hot air supplying apparatus according to another embodiment of the present invention.

Once the motor 1350 is fixed to the blower cover 1330, the blower cover 1330, as shown in FIG. 5, is loaded on the lower housing 1320. Subsequently, screws 1380 are locked via the locking holes 1336 and long holes 1337 of the flange 1335 and the locking holes 1322 of the lower housing 1320, respectively to assemble the blower cover 1330 to the lower housing 1320.

As mentioned in the above explanation, if positions of the locking holes 1322 of the lower housing are changed according to the capacity of the washer, the screws 1358 can be locked in another adjacent locking holes 1336 among the locking holes 1336, respectively. Moreover, since the long holes 1336 are provided for another screw locking, it is able to cope with a slight position variation of the corresponding locking hole 1322 of the lower housing 1320. Hence, without changing the structure and size of the blower cover and the locking hole position, and the like despite the variation of the applicable model according to the washing capacity, it is able to configure the hot air supplying apparatus using the same blower cover.

Moreover, even if the size of the motor 1350 is changed, the locking screw 1356 projected from the motor 1350 avoids contacting with the motor guide 1370 and the power cable 1352 of the motor 1350 can be easily drawn out via one of the cable guide slots 1373 provided to various locations of the motor guide 1370. Hence, it is able to fix the motor 1350 variously differing in size thereto using the same blower cover 1330 without modifying the structure of the blower cover 1330.

Accordingly, by forming the upper housing with the zinc plate and by forming the blower and blower cover with the synthetic resin material by injection molding, the present invention simplifies the manufacturing process and lowers the product cost, thereby enhancing user's economical advantage and reliability on the product and manufacturer.

Moreover, the same blower cover is applicable despite modifications of the structures and sizes of the lower housing and motor according to the capacity of the washer, whereby the present invention enhances compatibility, lowers the product cost, and facilitates maintenance and management thereof.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for supplying hot air in a drum washer, comprising:

a first duct housing provided to a tub included in the drum type washer;

a second duct housing provided to an upper side of the first duct housing;

a blower cover provided to the upper side of the first duct housing adjacent to the second duct housing, the blower cover being formed of a synthetic resin based injection material;

a heater provided between the first and second duct housings;

a motor provided to the blower cover; and a blower provided under the blower cover, the blower being rotatably connected to the motor, wherein a perforated recess for receiving the motor therein is provided to the blower cover and wherein a motor guide protrudes upward from the blower cover along an outer circumference of the recess to have the motor loaded thereon.

2. The apparatus of claim 1, wherein the blower is formed of an injection material of a synthetic resin based material.

3. The apparatus of claim 1, wherein the second duct housing is formed of an injection material of a synthetic resin based material.

4. The apparatus of claim 1, wherein the second duct housing is formed of zinc.

5. The apparatus of claim 1, wherein the motor guide is built in one body of the blower cover by injection molding.

6. The apparatus of claim 1, wherein the motor guide is separately formed to be assembled to the blower cover.

7. The apparatus of claim 6, wherein the motor guide is an injection material of a synthetic resin based material.

8. The apparatus of claim 1, wherein the motor guide comprises a plurality of bosses having screws locked therein for coupling with the motor, respectively and at least one escape recess for receiving a projected portion of a locking screw separately locked in the motor.

9. The apparatus of claim 8, wherein a plurality of cable guide slots are provided to the motor guide, each guide slot being configured to guide a power cable of the motor.

10. An apparatus for supplying hot air in a drum washer with dry function, comprising:

a first duct housing provided to a tub included in the drum type washer;

a second duct housing provided to an upper side of the first duct housing;

a blower cover provided to the upper side of the first duct housing adjacent to the second duct housing, the blower cover being formed of a synthetic resin based material, and the blower cover having a recess;

a heater provided between the first and second duct housings;

a motor coupled with the recess of the blower cover;

a blower provided under the blower cover, the blower being rotatably connected to the motor; and a motor guide protruding upward along an outer circumference of the recess of the blower cover, the motor guide comprising:

a plurality of bosses having screws locked therein for coupling with the motor, respectively; and at least one escape recess for receiving a projected portion of a locking screw separately locked in the motor.

11. The apparatus of claim 10, wherein a plurality of cable guide slots are provided to the motor guide, each guide slot being configured to guide a power cable of the motor.

12. The apparatus of claim 10, wherein the blower is formed of an injection material of a synthetic resin based material.

13. The apparatus of claim 10, wherein the second duct housing is formed of an injection material of a synthetic resin based material.

14. The apparatus of claim 10, wherein the second duct housing is formed of zinc.

15. The apparatus of claim 10, wherein the motor guide is built in one body of the blower cover by injection molding.

16. The apparatus of claim 10, wherein the motor guide is separately formed to be assembled to the blower cover.

17. The apparatus of claim 10, further comprising a guide part provided to one side of the motor guide, the guide part having a support recess fixedly supporting an external hose therein.

18. The apparatus of claim 10, further comprising a flange provided to a circumference of the blower cover.

19. The apparatus of claim 18, wherein a plurality of locking holes are provided to the flange and are provided at prescribed distances from each other hole.

20. The apparatus of claim 19, wherein a shape of the locking hole comprises at least one of a circular, square, oval, or rectangular shape.

* * * * *